US006189348B1

(12) United States Patent
Huang

(10) Patent No.: US 6,189,348 B1
(45) Date of Patent: Feb. 20, 2001

(54) RETIGHTENABLE AND RESETTABLE STRAP LOCK

(76) Inventor: Chien-Yung Huang, 5E10, No. 5, Sec. 5, Hsin Yi Rd., Taipei (TW)

( * ) Notice: Under 35 U.S.C. 154(b), the term of this patent shall be extended for 0 days.

(21) Appl. No.: 09/498,325

(22) Filed: Feb. 4, 2000

(51) Int. Cl.[7] ..... E05B 73/00

(52) U.S. Cl. ..... 70/18; 70/30; 70/312; 70/57; 24/615; 24/625

(58) Field of Search ..... 24/614–616, 625, 24/633; 70/14, 18, 19, 30, 49, 57, 58, 64, 65, 67–71, 312, 314

(56) References Cited

U.S. PATENT DOCUMENTS

| | | | | |
|---|---|---|---|---|
| 3,798,711 | * | 3/1974 | Cousins | 24/616 X |
| 4,631,787 | * | 12/1986 | Kasai | 24/616 |
| 4,685,315 | * | 8/1987 | Comolli | 70/18 X |
| 4,688,337 | * | 8/1987 | Dillner et al. | 24/616 |
| 4,856,306 | * | 8/1989 | Scelba et al. | 70/312 X |
| 5,117,663 | * | 6/1992 | Ida | 70/64 |
| 5,136,864 | * | 8/1992 | Spiekermann et al. | 70/312 X |
| 5,193,368 | * | 3/1993 | Ling | 70/30 |
| 5,309,610 | * | 5/1994 | Le Gal | 24/615 X |
| 5,321,871 | * | 6/1994 | Oda | 70/68 X |
| 5,331,726 | * | 7/1994 | Suh | 24/625 |
| 5,471,717 | * | 12/1995 | Ennerdal et al. | 24/633 |
| 5,517,836 | * | 5/1996 | Hong | 70/30 |
| 5,548,879 | * | 8/1996 | Wu | 24/625 |
| 5,557,954 | * | 9/1996 | Ling | 70/69 X |
| 5,561,891 | * | 10/1996 | Hsieh | 24/616 X |
| 5,689,979 | * | 11/1997 | Yu | 70/69 |
| 5,692,403 | * | 12/1997 | Ling | 70/57 X |
| 5,709,014 | * | 1/1998 | Takahashi | 24/615 X |
| 5,893,199 | * | 4/1999 | Anshcer | 24/625 |
| 5,927,110 | * | 7/1999 | Yu | 70/69 X |
| 5,991,986 | * | 11/1999 | Canna et al. | 24/625 |
| 6,016,675 | * | 1/2000 | Te | 70/70 X |
| 6,061,883 | * | 5/2000 | Uehara | 24/615 X |
| 6,065,313 | * | 5/2000 | Huang | 70/68 |

* cited by examiner

*Primary Examiner*—Suzanne Dino Barrett
(74) *Attorney, Agent, or Firm*—Pro-Techtor International Services

(57) ABSTRACT

A retightenable and resettable strap lock for luggage includes a female buckle member with number wheels, a male buckle member for releasably engaging with the female buckle member, and a strap connected to the female buckle member and the male buckle member. A slide member is mounted in the female buckle member for restraining movement of the strap. An end of the strap is pullable to further tighten the luggage even if the male and female buckle members are engaged with each other, yet loosening of the strap by pulling the end of the strap in the opposite direction is prevented. A pull tab holder is mounted in the male buckle member for receiving two pull tabs of a zipper of the luggage. The pull tab holder is retained in place by the female buckle member when the male and female buckle members are engaged with each other.

11 Claims, 10 Drawing Sheets

RETIGHTENABLE AND RESETTABLE STRAP LOCK

BACKGROUND OF THE INVENTION

1. Field of the Invention

The present invention relates to a retightenable and resettable strap lock for luggage or the like, and more particularly to a retightenable and resettable strap lock that can be used to lock a strap for tightening luggage and two pull tabs of the luggage while allowing the strap to be further tightened for reliably tightening the luggage.

2. Description of the Related Art

It is common to carry a big trunk for accommodating clothing. FIG. 13 of the drawings illustrates a conventional buckle device for a trunk having a zipper with two pull tabs A1. A key-operable lock B is mounted to lock the pull tabs A1 together. Nevertheless, it is found that the zipper tends to be expanded outward and thus damaged if the trunk is filled up with too many clothes. A strap buckle is provided to tighten the trunk for solving this problem. As illustrated in FIGS. 14 and 15, the strap buckle includes a male buckle member C, a female buckle member D, a length-adjusting member E, and a strap F. The strap F has an end tied up to a central column E1 of the length-adjusting member E and is extended through an opening C1 of the male buckle member C and two openings E2 of the length-adjusting member E with the other end of the strap F secured to the female buckle member D. The length-adjusting member E may be moved for adjusting the overall length of the strap F before engagement between the male and female buckle members C and D. In order to avoid becoming loosened of the strap F, the length-adjusting member E is designed to have a relatively large friction and thus difficult to move after the male and female buckle members C and D have been engaged with each other. Thus, adjustment in the length of the strap F by means of moving the length-adjusting member E must be accomplished before engagement between the male and female buckle members C and D. Yet, such adjustment to the best tightening effect for the trunk is very difficult to achieve, as the user must estimate the required length of the strap F by sight, which is not so precise such that the strap is either too tight or too loose after each adjustment. The strap might become loosened and the male and female buckle members might be disengaged from each other upon external impingement to the trunk during transportation even if the best length of the strap is found. A further drawback of this conventional method for tightening trunks is that the user must use a lock and a strap buckle that are separate from each other.

The present invention is intended to provide a retightenable and resettable strap lock that mitigates and/or obviate the above problems.

SUMMARY OF THE INVENTION

It is a primary object of the present invention to provide a retightenable and resettable strap lock that allows retightening of the strap after the male and female buckle members have been engaged with each other. An end of the strap can be pulled in a direction to further tighten the luggage and thus will not become loosened even if the luggage is impinged during transportation or the strap is pulled in the opposite direction.

It is another object of the present invention to provide a retightenable and resettable strap lock, wherein the male buckle member includes a pull tab holder in a bottom thereof.

It is a further object of the present invention to provide a retightenable and resettable strap lock, wherein the code number for unlocking a number lock of the strap lock is resettable.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
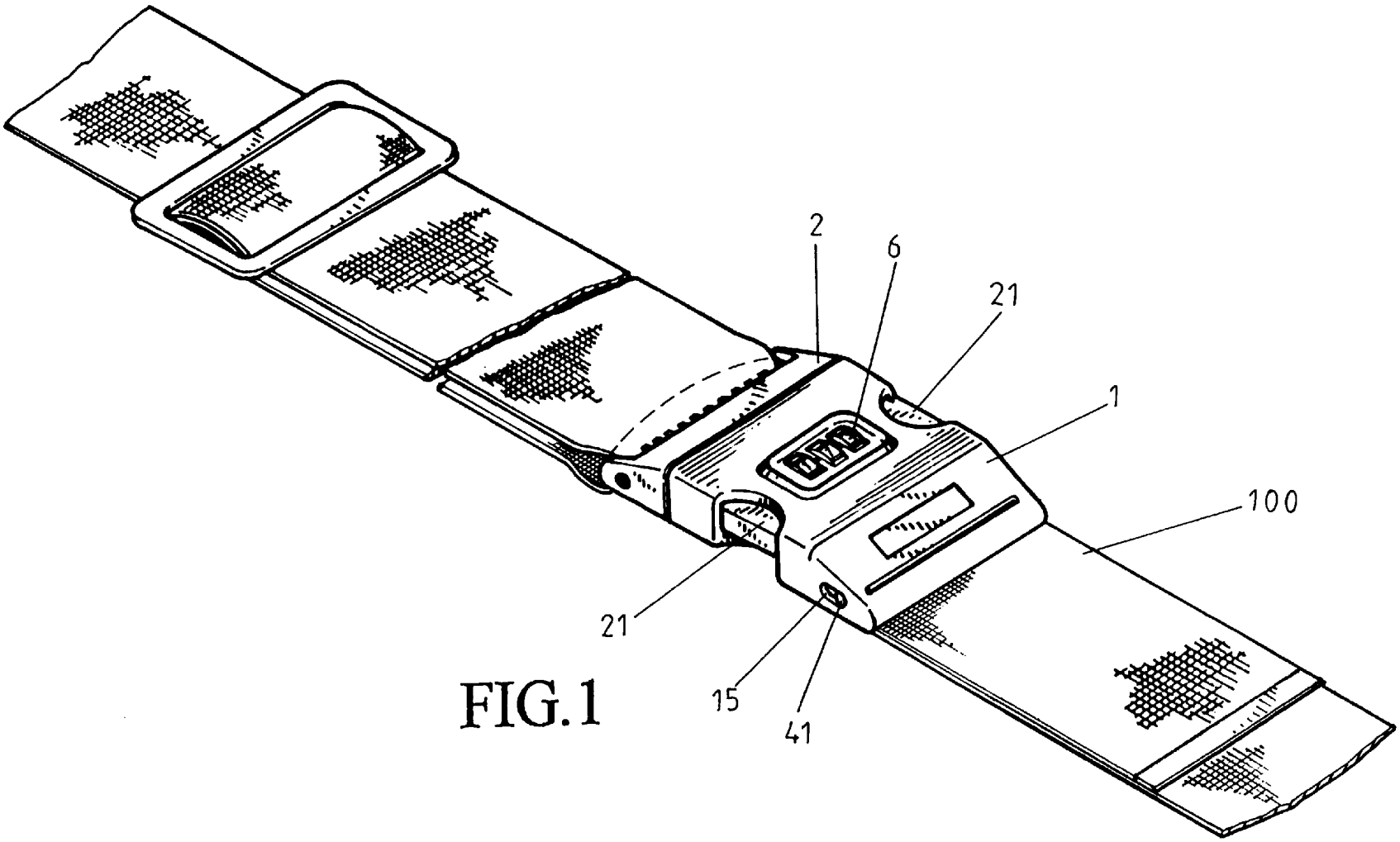
FIG. 1 is a perspective view of a retightenable and resettable strap lock in accordance with the present invention.

Referring to FIGS. 1 through 12 and initially to FIG. 1, a retightenable and resettable strap lock in accordance with the present invention generally includes a female buckle member 1, a male buckle member 2, a pull tab holder 3, a slide member 4, a base 5, a plurality of (e.g., three) number wheels 6, a plurality of (e.g., three) retaining sleeves 7, a spring 8, a stem 9, and an insert plate 10.

Figure 2:
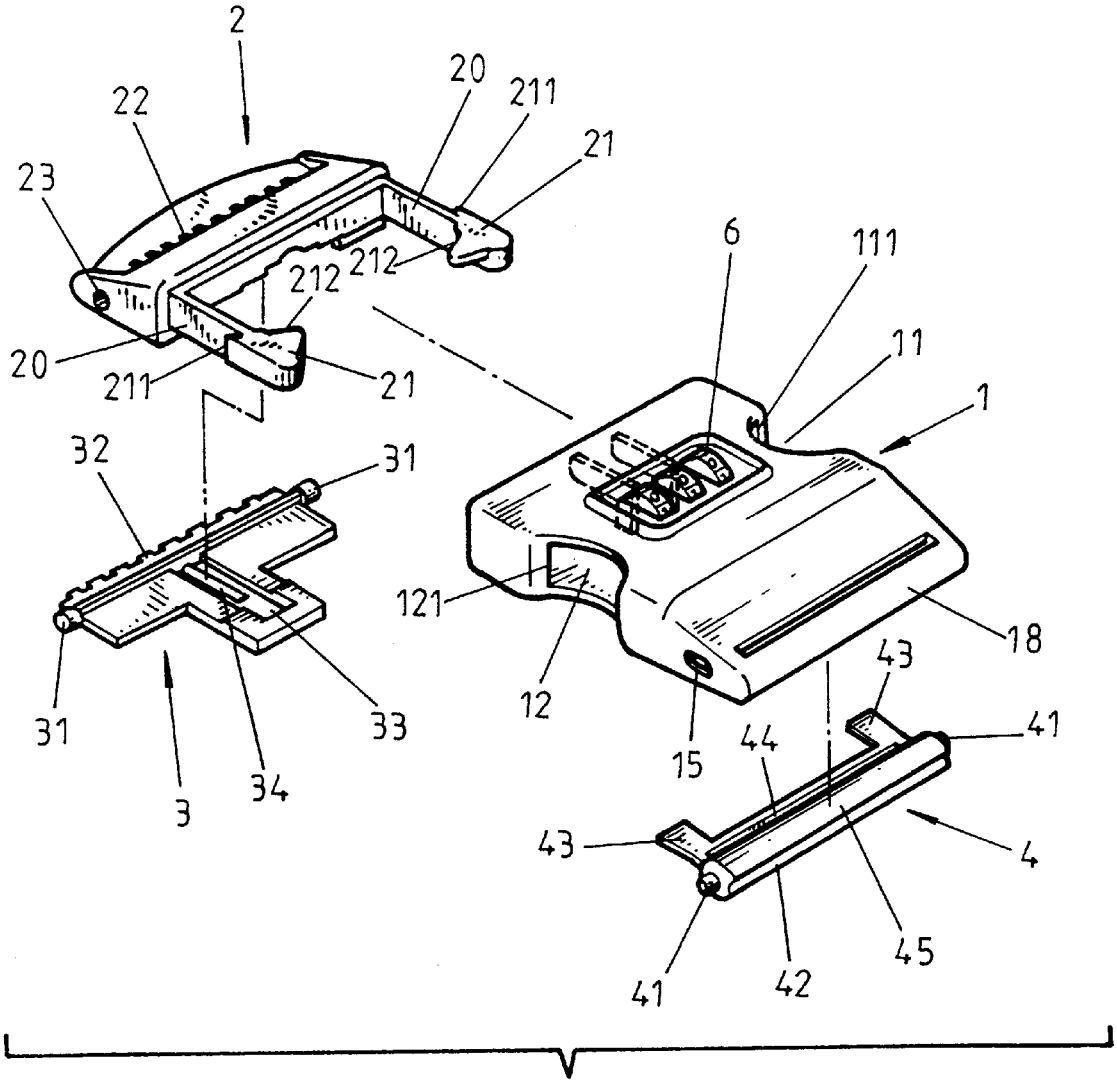
FIG. 2 is an exploded perspective view of a male buckle member and a female buckle member of the retightenable and resettable strap lock in accordance with the present invention.
Figure 3:
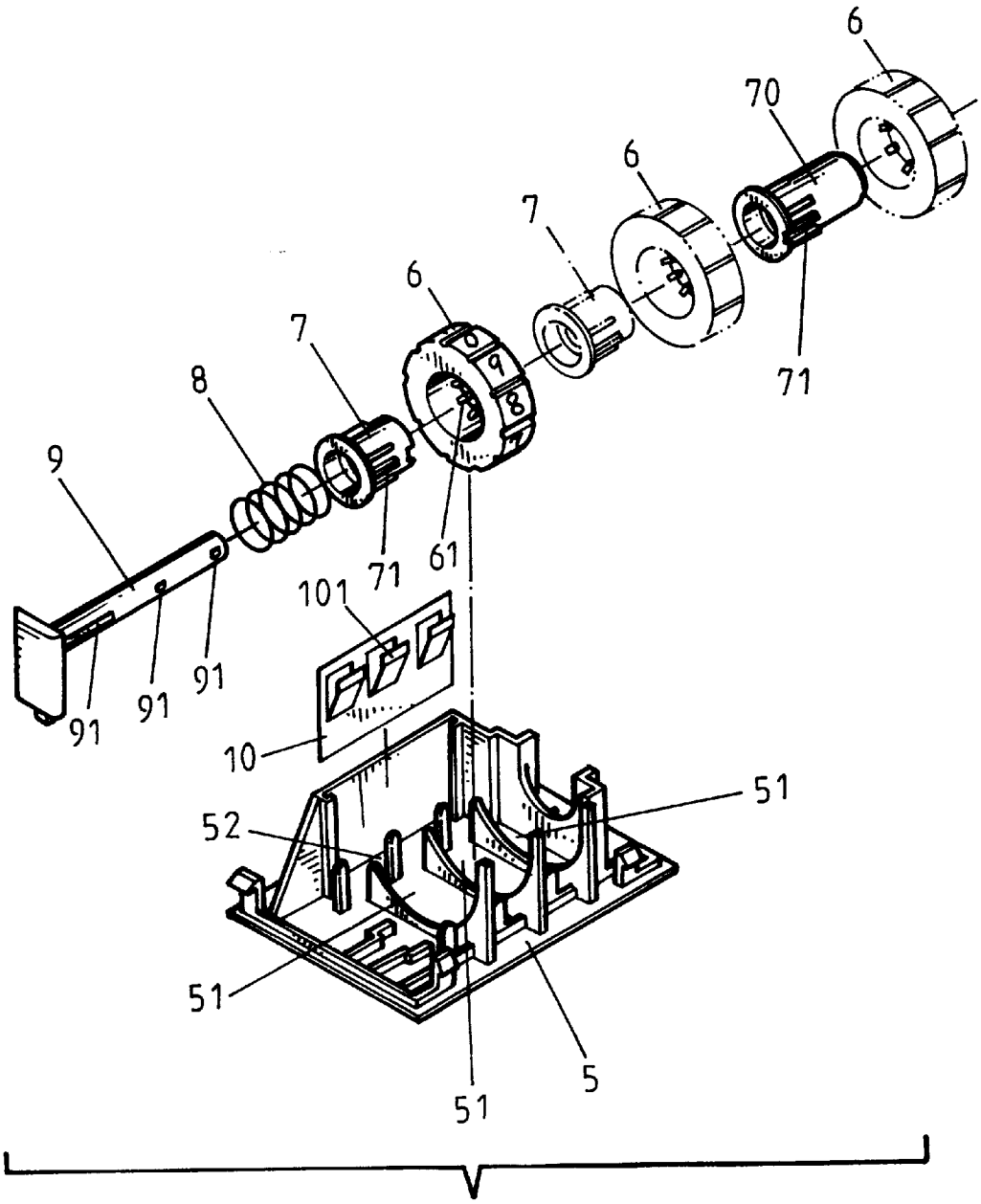
FIG. 3 is an exploded perspective view of a base and a lock assembly of the retightenable and resettable strap lock in accordance with the present invention.
Figure 4:
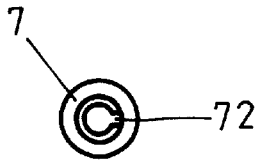
FIG. 4 is an end view of a retaining sleeve of the lock assembly of the retightenable and resettable strap lock in accordance with the present invention.
Figure 5:
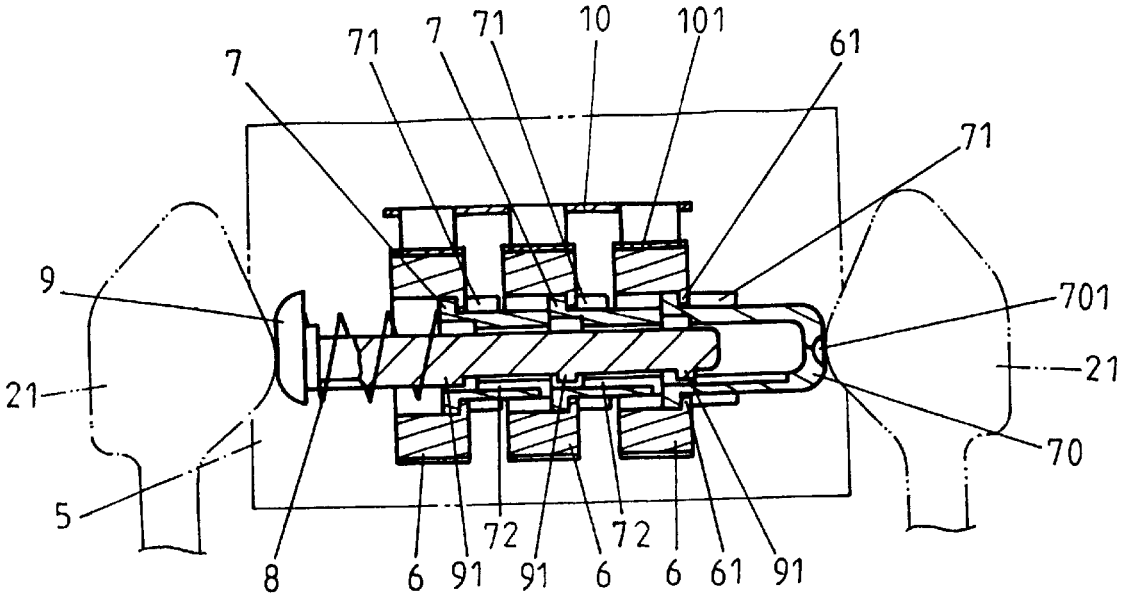
FIG. 5 is a schematic sectional view of the retightenable and resettable strap lock in accordance with the present invention, wherein the lock assembly is in an unlocked status.
Figure 6:
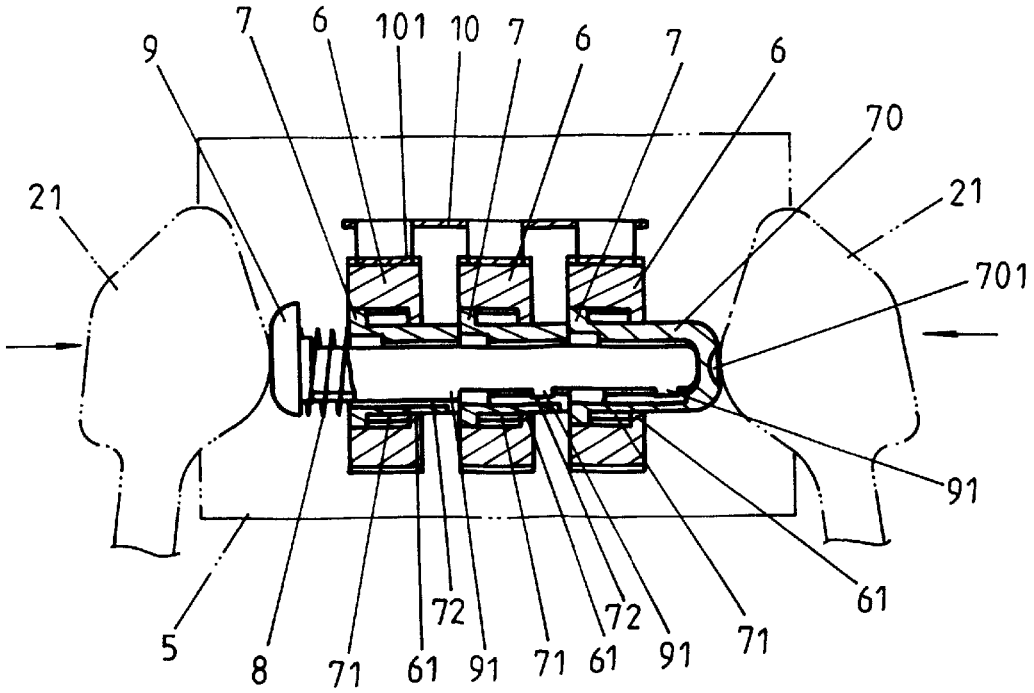
FIG. 6 is a sectional view similar to FIG. 5, wherein the lock assembly is in an unlocked status and wherein the female buckle member and the male buckle member are to be disengaged from each other.

Still referring, to FIG. 1 and further to FIGS. 2, 3, and 5, the base 5 is securely mounted in the female buckle member 1 and includes three compartments 51 for rotatably receiving the number wheels 6, respectively. Each number wheel 6 includes a longitudinal hole (not labeled) through which an associated retaining sleeve 7 is extended. Teeth 61 formed on an inner periphery of each number wheel 6 is engaged with teeth 71 on an outer periphery of the associated retaining sleeve 7 such that the number wheel 6 and the associated retaining sleeve 7 may rotate together. The base 5 further has a compartment 52 behind the compartments 51 for receiving the insert plate 10. The insert plate 10 includes three resilient pieces 101, each resilient piece 101 being releasably retained in a plurality of grooves (not labeled) in an outer periphery of an associated number wheel 6 and thus generating a sound when the number wheel 6 is rotated through a pre-determined angle. In this embodiment, the number wheel 6 includes ten grooves (not labeled) in an outer periphery thereof, and the resilient piece 101 produces a sound when it is passed from one groove to next groove in the number wheel 6. The spring 8 is mounted around a portion of the stem 9. The stem 9 is extended through the retaining sleeves 7 and includes a plurality of spaced protrusions 91 each for engaging with a retaining groove 72 (FIG. 4) of each retaining sleeve 7. As illustrated in FIG. 5, the rightmost retaining sleeve 7 is longer and includes an end wall defining a blind hole (not shown) for receiving an end of the stem 9. The rightmost retaining sleeve 7 includes a depression 701 in an end face thereof such that the user may insert a sharp tool into the depression 701 and thus push the retaining sleeves 7 leftward for changing (resetting) the code number of the lock assembly consisting of the number wheels 6, the retaining wheels 7, the base 5, the spring 8, the stem 9, and the insert plate 10.

As illustrated in FIG. 2, the male buckle member 2 includes two substantially U-shape resilient arms 20 each having a push member 21 with a barb 211 and a slant face 212. The female buckle member 1 further includes two side retaining holes 11 and 12 for releasably engaging with the barbs 211 of the push members 21. Each retaining hole 11, 12 has a retaining element 111, 121 formed therein for engaging with the barb 211 of the associated push member 2 such that the male and female buckle members 2 and 1 are maintained in engagement with each other unless the push members 21 are pressed toward each other.

Figure 9:
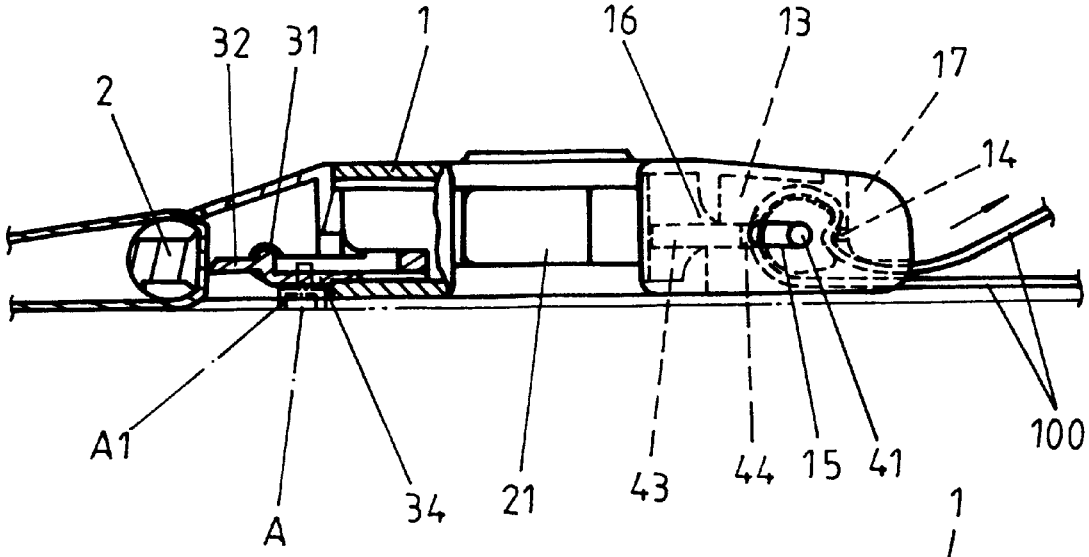
FIG. 9 is a longitudinal sectional view of the retightenable and resettable strap lock in accordance with the present invention.
Figure 10:
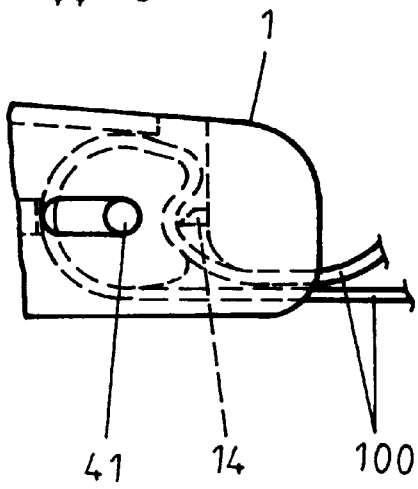
FIG. 10 is an enlarged view of a portion in FIG. 9.

The female buckle member 2 further includes a compartment 13 (FIG. 9) for receiving the slide member 4. A retaining member (e.g., a series of teeth 14, FIG. 10) is arranged on a side wall 17 defining a portion of the compartment 13. The compartment 13 further includes two accesses 16 into which two protrusions 43 of the slide member 4 are extended, respectively. The slide member 4 further includes two studs 41 formed on two ends, respectively. The studs 41 of the slide member 4 are mounted in two axial holes 15 respectively defined in two sides of the female buckle member 1 such that the slide member 4 is allowed to move laterally while preventing rotation of the slide member 4. The slide member 4 further includes a groove 42 in a lateral side thereof facing away the projections 43. Also defined in the slide member 4 is a slot 44 through which the strap 100 is extended. As illustrated in FIG. 9, an end of the strap 100 is extended through the slot 44 of the slide member 4 and then through a gap between the teeth 14 of the female buckle member 1 and the groove 42 of the slide member 4. Thus, the end of the strap 100 is outside the buckle members 1 and 2 for manual adjustment.

When the male and female buckle members 2 and 1 are engaged with each other, the push members 21 of the male buckle member 2 respectively push the projections 43 of the slide member 4 and thus move the slide member 4 until it bears against the strap 100 (the studs 41 of the slide member 4 are slid toward the right side of the axial holes 15 of the female buckle member 1, see FIG. 9). Thus, the strap 100 is retained in place, as a portion of the strap 100 is retained between the teeth 14 of the female buckle member 1 and the groove 42 of the slide member 4. In this case, the user may pull the end of the strap 100 (the upper section in FIG. 10) outward to further tightening (or retightening) the trunk (FIG. 12), as the other end of the strap 100 is secured to the male buckle member 2. More specifically, when the user pulls the end of the strap 100 outward, the strap 100 may move along an inclined surface of the teeth 14. As a result, the trunk is further tightened (or retightened) when desired. It is noted that intention of loosening the strap 100 by means of pulling the strap section (the lower one in FIG. 10) outward is avoided due to provision of the teeth 14. When the male and female buckle members 2 and 1 are disengaged from each other, the projections 43 of the slide member 43 are no longer retained by the push members 21 such that the teeth of the slide member 43 may be disengaged from the strap 100 by means of sliding the slide member 43 away from the strap 100. As a result, the strap 100 may be adjusted to a required length for tightening.

Figure 11:
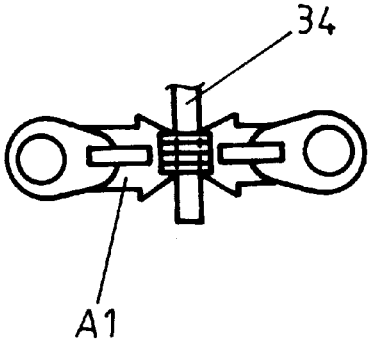
FIG. 11 is a top view illustrating engagement of two pull tabs and a pull tab holder of the retightenable and resettable strap lock in accordance with the present invention.
Figure 12:
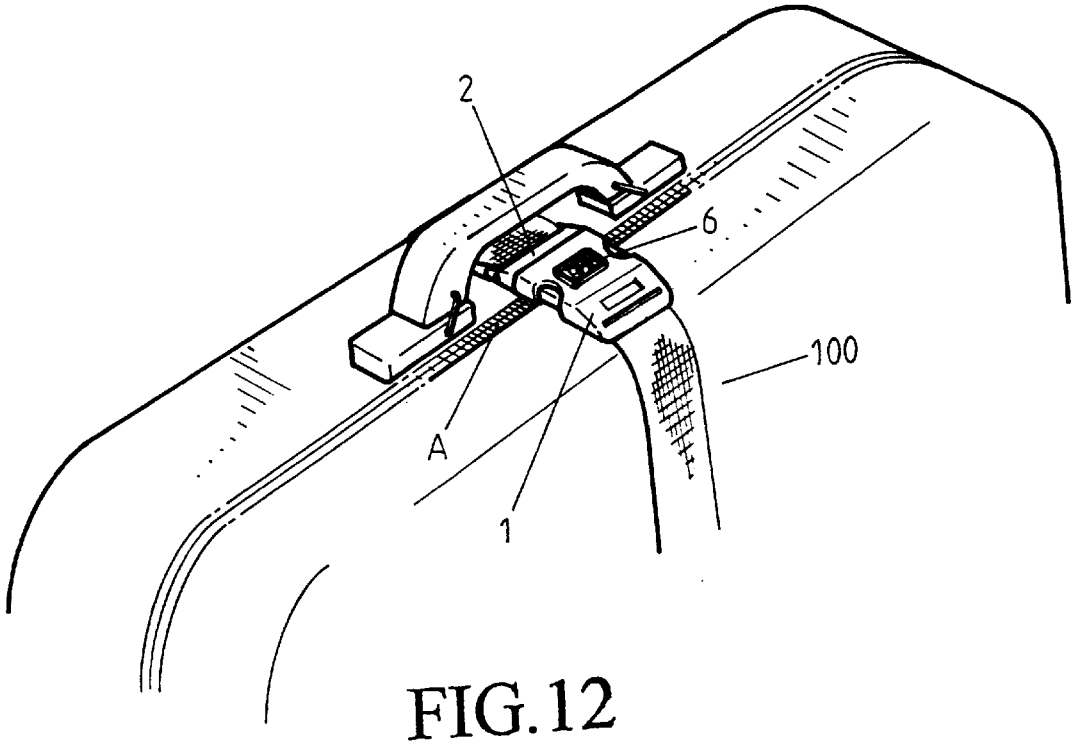
FIG. 12 is a schematic view illustrating application of the retightenable and resettable strap lock in accordance with the present invention to a trunk.
Figure 13:
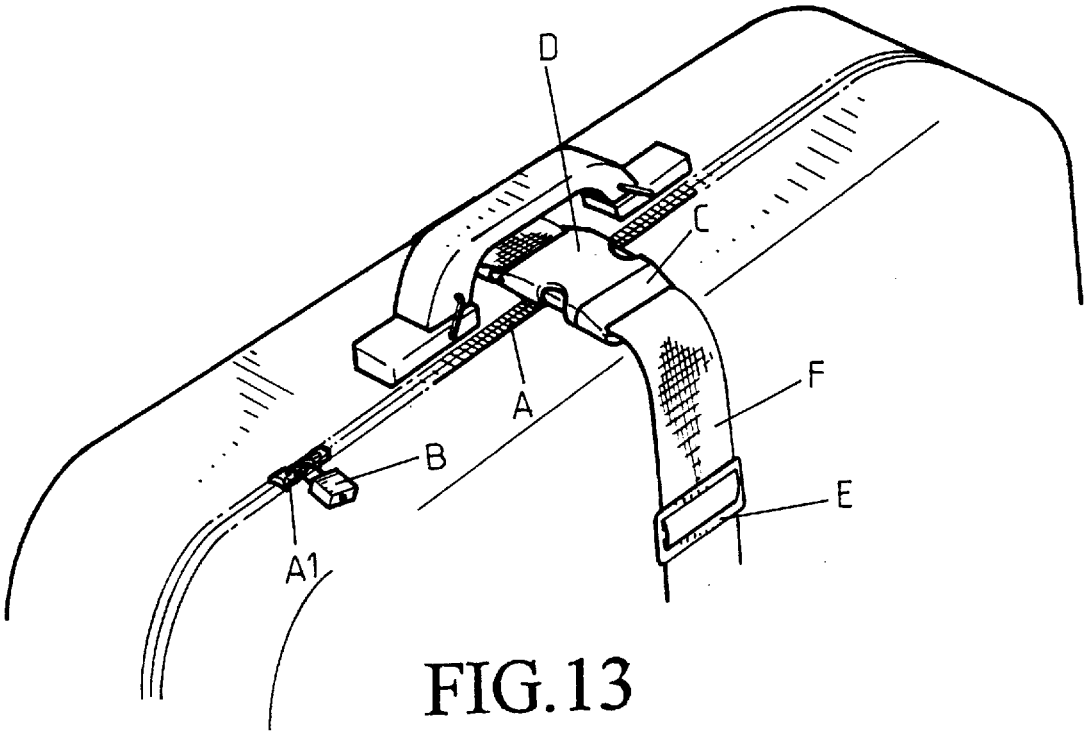
FIG. 13 is a schematic view illustrating application of a conventional buckle to a trunk.
Figure 14:
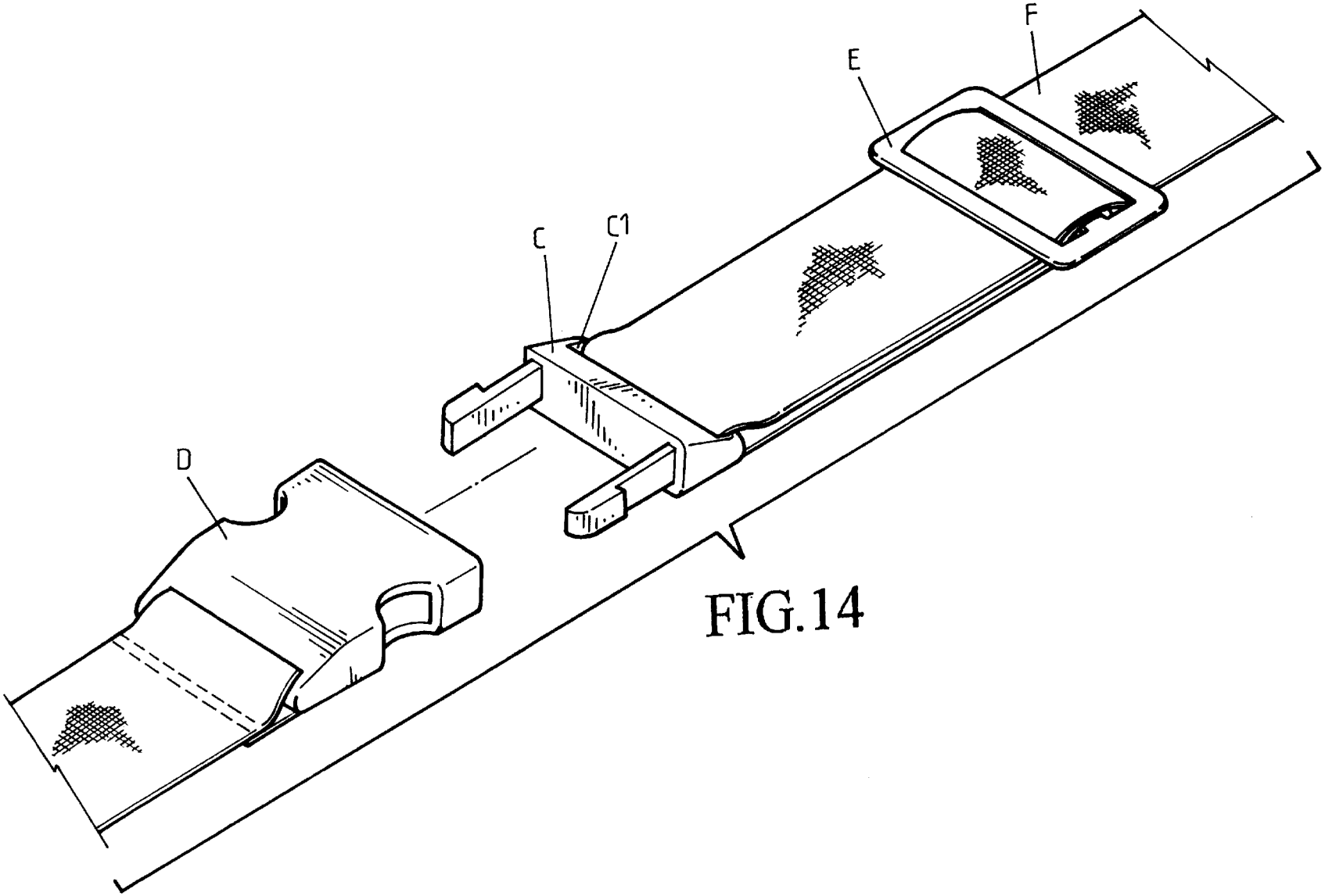
FIG. 14 is a partial perspective view of the conventional buckle in FIG. 13.
Figure 15:
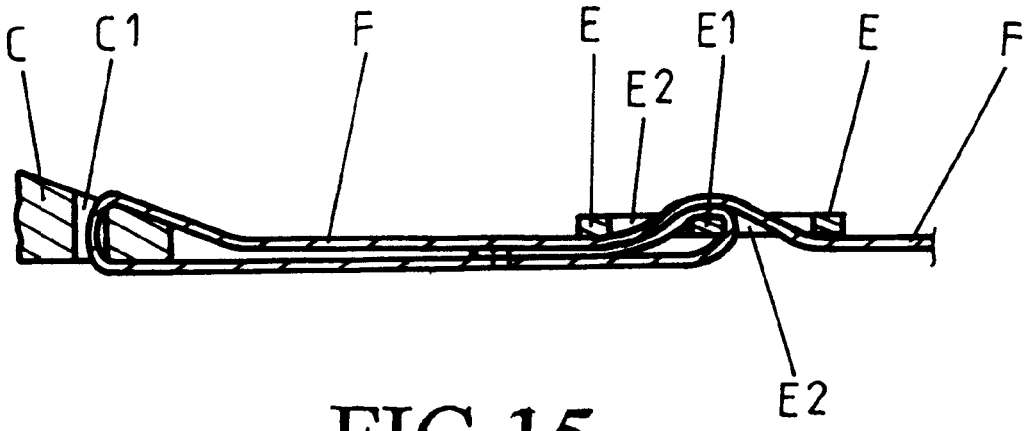
FIG. 15 is a sectional view of a main portion of the conventional buckle in FIG. 13.

The pull tab holder 3 includes two pintles 31 respectively formed on two ends thereof. Each pintle 31 is pivotally received in a hole 23 in an associated side of the male buckle member 2. Formed on a lateral side of the pull tab holder 3 is a series of teeth 32 for releasably retaining the other end of the strap 100 in place. The other end of the strap 100 in FIG. 9 is in a status firmly pressed by the teeth 32. Formed on the other lateral side of the pull tab holder 3 is a recess 33 with a hook 34 formed therein. As illustrated in FIG. 11, when two pull tabs A1 of a zipper A of the trunk (FIG. 12) are in contact with or close to each other, the pull tabs A1 may be put into the recess 33 and engaged with the hook 34 of the pull tab holder 3. When the male and female buckle members 2 and 1 are engaged with each other, the female buckle member 2 encloses the recess 3 and thus retains the pull tabs A1 in place. Removal of the pull tabs A1 can be accomplished by reversing the above steps.

Referring to FIG. 5, when the number wheels 6 are turned to the correct code number position, the grooves 72 of the retaining sleeves 7 are aligned with the protrusions 91 on the stem 9. In this case, the user may press the push members 21 of the male buckle member 2 inward to simultaneously push the stem 9 and the rightmost sleeve 7 inward for disengaging the male buckle member 2 from the female buckle member 1, best shown in FIG. 6. It is noted that the teeth 71 of each retaining sleeve 7 is maintained in engagement with the teeth 61 of the associated number wheel 6 such that the number wheels 6 are not rotatable.

Figure 7:
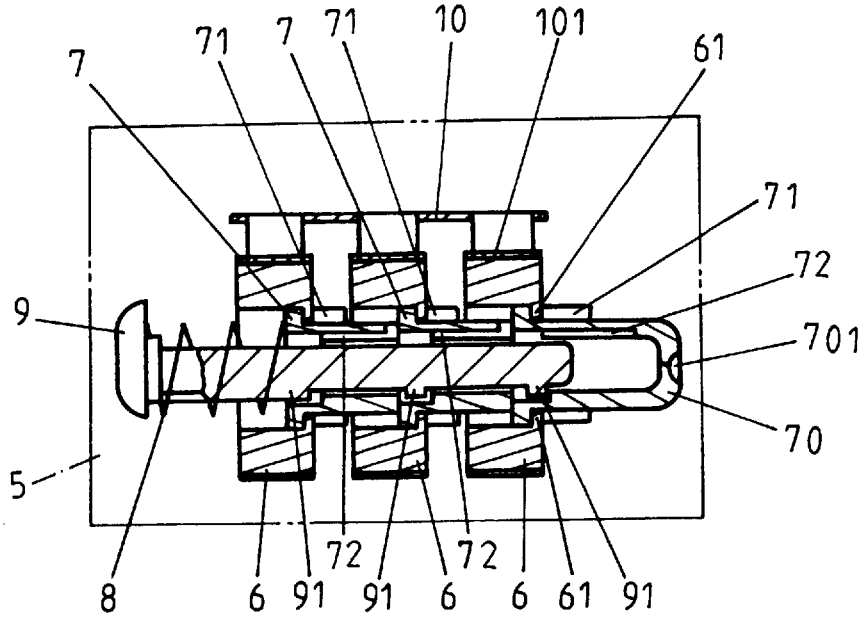
FIG. 7 is a sectional view similar to FIG. 5, wherein the lock assembly is in a locked status.

Referring to FIG. 7, when the number wheels 6 are not in the correct code number position, the grooves 72 of the retaining sleeves 7 are not aligned with the protrusions 91 on the stem 9 such that the retaining sleeves 7 and the stem 9 cannot be moved toward each other. As a result, the push members 21 of the male buckle member 2 cannot be pushed inward. Consequently, the barbs 211 are maintained in engagement with the retaining elements 111 and 121.

Figure 8:
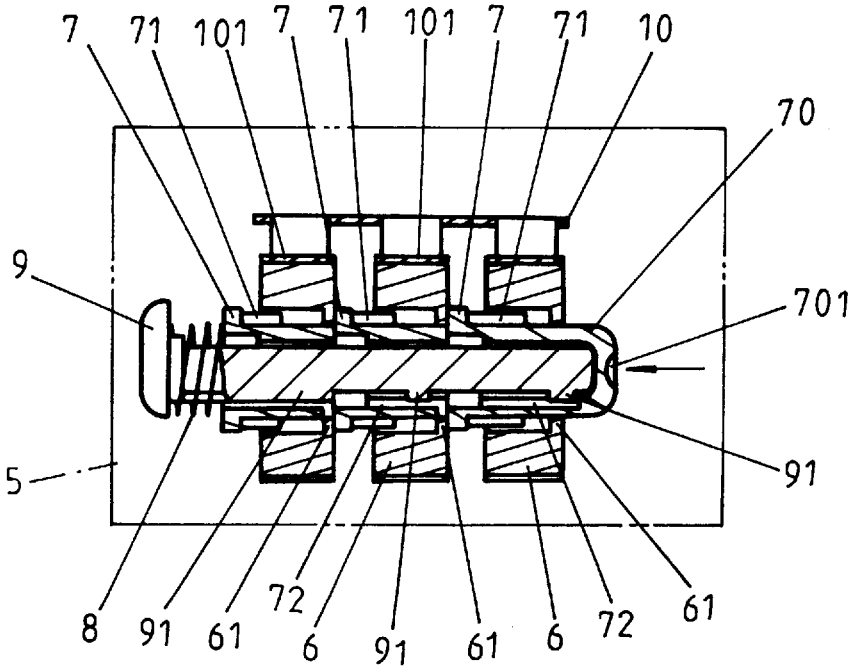
FIG. 8 is a sectional view similar to FIG. 5, wherein the lock assembly is in a status allowing resetting in the code number for unlocking.

Referring to FIG. 8, when the number wheels 6 are turned to the correct code number position such that the grooves 72 of the retaining sleeves 7 are aligned with the protrusions 91 on the stem 9, the user may insert a tool (e.g., a pen) into the depression 701 of the rightmost retaining wheel 7 and apply an inward force to the tool, all of the retaining sleeves 7 are moved leftward and compress the spring 8 such that the teeth 71 of the retaining sleeves 7 are disengaged from the teeth 61 of the number wheels 6. As a result, the retaining sleeves 7 may rotate freely relative to the number wheels 6. Thus, the user may turn the number wheels 6 to a new code number whatever he/she likes. Release of the tool finishes resetting in the code number for unlocking.

Although the lock assembly is illustrated in the form of a number lock, it is noted that other types of locks can be used to achieve the same function.

According to the above description, it is appreciated that the strap lock in accordance with the present invention may be applied to a trunk or the like in which adjustment of the length of strap for tightening the trunk can be proceeded after the male and female buckle members has been engaged with each other and such adjustment is relatively easy to achieve. In addition, adjustment of the length of strap for tightening/retightening the trunk can be accomplished when the trunk is still in a locked status. The pull tabs of the zipper of the trunk are also locked by the strap lock in accordance with the present invention. Thus, inconvenient use of lock/strap buckle required for conventional tightening of trunks is avoided. Further, resetting of the code number of the lock assembly of the strap lock in accordance with the present invention can be easily accomplished.

Although the invention has been explained in relation to its preferred embodiment, it is to be understood that many other possible modifications and variations can be made without departing from the spirit and scope of the invention as hereinafter claimed.

What is claimed is:

1. A strap lock for an article, comprising:

a male buckle member, a female buckle member for releasably engaging with the male buckle member, a strap having a first end secured to one of the male buckle member and the female buckle member, the strap being extended through the other of the male buckle member and the female buckle member, a second end of the strap being extended beyond the other of the male buckle member and the female buckle member, and means for releasably engaging the strap mounted to the other of the male buckle member and the female buckle member, said means for releasably engaging the strap being configured to allow pulling of the second end of the strap in a first direction for further tightening the article and to prevent movement of the second end of the strap in a second direction opposite to the first direction for loosening the article, and said means allowing free movement of the second end of the strap when the male buckle member and the female buckle member are disengaged from each other, one of the male buckle member and the female buckle member includes a lock assembly for maintaining the male buckle member and the female buckle member in the engaged status when the lock assembly is in a locked status and for allowing disengagement of the male buckle member and the female buckle member when the lock assembly is in an unlocked status, the lock assembly comprising a plurality of number wheels rotatably mounted in the female buckle member; each said number wheel including a longitudinal hole, the longitudinal hole including a first engaging means on an inner periphery thereof;

a plurality of retaining sleeves each of which is mounted in the longitudinal hole of an associated said number wheel, each said retaining sleeve including a second engaging means on an outer periphery thereof for releasably engaging with the first engaging means of the associated number wheel to allow joint rotation of the retaining sleeve and the number wheel, each said retaining sleeve including a groove in an inner periphery thereof;

a stem slidably extended through the retaining sleeves and including a first end outside the retaining sleeves and a second end located in one of the retaining sleeves that is most distal to the first end of the stern; said one of the retaining sleeves that is most distal to the first end of the stem including an end wall, the stem including a plurality of spaced protrusions for releasably engaging with the grooves of the retaining sleeves; and a spring mounted around the stem and attached between the first end of the stem and one of the retaining sleeve for biasing the first end of the stem and the end wall of the retaining wheel away from each other;

the male buckle member including two resilient push members respectively formed on two sides thereof, each said resilient member including a barb, one of the resilient push members being located outside the first end of the stem, the other of the resilient push members being located outside the end wall of said one of the retaining sleeves most distal to the first end of the stem;

the female buckle member including two side retaining holes each having a retaining member for releasably engaging with the barb of an associated said resilient member;

said means for releasably engaging with the strap being a slide member mounted in the female buckle member and including two protrusions on a first side thereof and a series of teeth on a second side thereof for releasably engaging with the strap, the slide member being slidable relative to the female buckle member along a lateral direction;

whereby when the male buckle member and the female buckle member are engaged with each other, the push members of the male buckle member push the protrusions of the slide member and thus make the teeth of the slide member move toward and thus engage with the strap to allow pulling of the second end of the strap in the first direction for further tightening the article and to prevent movement of the second end of the strap in the second direction opposite to the first direction for loosening the article;

whereby when the male buckle member and the female buckle member are disengaged with each other; the slide member is slidable away from the strap and thus makes the teeth of the slide member disengage from the strap to allow free movement of the second end of the strap;

whereby when the number wheels are not in correct code number position, the grooves of the retaining sleeves are not aligned with the protrusions of the stem such that the stem and the retaining wheels are not movable toward each other, the barbs of the male buckle member cannot be disengaged from the retaining elements of the female buckle member when the push members of the male buckle member are pushed toward each other, and whereby when the number wheels are in the correct code number position, the grooves of the retaining sleeves are aligned with the protrusions of the stem such that the stem and the retaining wheels are movable toward each other; the barbs of the male buckle member are disengaged from the retaining elements of the female buckle member when the push members of the male buckle member are pushed toward each other.

2. The strap lock as claimed in claim 1, wherein the lock assembly is a number lock.

3. The strap lock as claimed in claim 2, wherein a code number for unlocking the number lock is resettable.

4. A strap lock for luggage with a zipper having two pull tabs, comprising:

a male buckle member;

a female buckle member for releasably engaging with the male buckle member;

a strap having a first end secured to the male buckle member and a second end secured to the female buckle member; the strap being adjustable in length for tightening the luggage; and a pull tub holder mounted in one of the male buckle member and the female member for holding the pull tabs when the male buckle member and the female member are engaged with each other; and one of the male buckle member and the female buckle member includes a lock assembly for maintaining the male buckle member and the female buckle member in the engaged status when the lock assembly is in a locked status and for allowing disengagement of the male buckle member and the female buckle member when the lock assembly is in an unlocked status, the lock assembly comprises a plurality of number wheels rotatably mounted in the female buckle member; each said number wheel including a longitudinal hole, the longitudinal hole including a first engaging means on an inner periphery thereof;

a plurality of retaining sleeves each of which is mounted in the longitudinal hole of an associated said number wheel, each said retaining sleeve including a second engaging means on an outer periphery thereof for releasably engaging with the first engaging means of the associated number wheel to allow joint rotation of the retaining sleeve and the number wheel, each said retaining sleeve including a groove in an inner periphery thereof;

a stem slidably extended through the retaining sleeves and including a first end outside the retaining sleeves and a second end located in one of the retaining sleeves that is most distal to the first end of the stern; said one of the retaining sleeves that is most distal to the first end of the stem including an end wall, the stem including a plurality of spaced protrusions for releasably engaging with the grooves of the retaining sleeves; and a spring mounted around the stem and attached between the first end of the stem and one of the retaining sleeve for biasing the first end of the stem and the end wall of the retaining wheel away from each other;

the male buckle member including two resilient push members respectively formed on two sides thereof; each said resilient member including a barb, one of the resilient push members being located outside the first end of the stern; the other of the resilient push members being located outside the end wall of said one of the retaining sleeves most distal to the first end of the stem;

the female buckle member including two side retaining holes each having a retaining member for releasably engaging with the barb of an associated said resilient member;

said means for releasably engaging with the strap being a slide member mounted in the female buckle member and including two protrusions on a first side thereof and a series of teeth on a second side thereof for releasably engaging with the strap, the slide member being slidable relative to the female buckle member along a lateral direction;

whereby when the male buckle member and the female buckle member are engaged with each other; the push members of the male buckle member push the protrusions of the slide member and thus make the teeth of the slide member move toward and thus engage with the strap to allow pulling of the strap in the first direction for further tightening the article and to prevent movement of the strap in the second direction opposite to the first direction for loosening the article;

whereby when the male buckle member and the female buckle member are disengaged with each other, the slide member is slidable away from the strap and thus makes the teeth of the slide member disengage from the strap to allow free movement of the strap;

whereby when the number wheels are not in correct code number position, the grooves of the retaining sleeves are not aligned with the protrusions of the stem such that the stem and the retaining wheels are not movable toward each other; the barbs of the male buckle member cannot be disengaged from the retaining elements of the female buckle member when the push members of the male buckle member are pushed toward each other, and whereby when the number wheels are in the correct code number position, the grooves of the retaining sleeves are aligned with the protrusions of the stem such that the stem and the retaining wheels are movable toward each other; the barbs of the male buckle member are disengaged from the retaining elements of the female buckle member when the push members of the male buckle member are pushed toward each other.

5. The strap lock as claimed in claim 4, wherein the pull tabs are hidden in the male buckle member and the female buckle member when the male buckle member and the female buckle member are engaged with each other.

6. The strap lock as claimed in claim 4, wherein the lock assembly is a number lock.

7. The strap lock as claimed in claim 6, wherein a code number for unlocking the number lock is resettable.

8. The strap lock as claimed in claim 4, further comprising means mounted in one of the male buckle member and the female buckle member for releasably engaging with the strap, said means for releasably engaging with the strap being configured to allow pulling of the strap in a first direction for further tightening the article and to prevent movement of the strap in a second direction opposite to the first direction for loosening the luggage, and said means allowing free movement of the strap when the male buckle member and the female buckle member are disengaged from each other.

9. A strap lock for luggage with a zipper having two pull tabs, comprising:

a male buckle member;

a female buckle member for releasably engaging with the male buckle member, a strap having a first end secured to one of the male buckle member and the female buckle member, the strap being extended through the other of the male buckle member and the female buckle member with a second end thereof beyond the other of the male buckle member and the female buckle member for manual pulling;

means for releasably engaging with the strap and mounted to the other of the male buckle member and the female buckle member; said means for releasably engaging with the strap being configured to allow pulling of the second end of the strap in a first direction for further tightening the article and to prevent movement of the second end of the strap in a second direction opposite to the first direction for loosening the article, and said means allowing free movement of the second end of the strap when the male buckle member and the female buckle member are disengaged from each other; and a pull tub holder mounted in one of the male buckle member and the female buckle member for releasably holding the pull tabs when the male buckle member and the female buckle member are engaged with each other; wherein one of the male buckle member and the female buckle member includes a lock assembly for maintaining the male buckle member and the female buckle member in the engaged status when the lock assembly is in a locked status and for allowing disengagement of the male buckle member and the female buckle member when the lock assembly is in an unlocked status, the lock assembly comprising a plurality of number wheels rotatably mounted in the female buckle member; each said number wheel including a longitudinal hole, the longitudinal hole including a first engaging means on an inner periphery thereof;

a plurality of retaining sleeves each of which is mounted in the longitudinal hole of an associated said number wheel, each said retaining sleeve including a second engaging means on an outer periphery thereof for releasably engaging with the first engaging means of the associated number wheel to allow joint rotation of the retaining sleeve and the number wheel, each said retaining sleeve including a groove in an inner periphery thereof;

a stem slidably extended through the retaining sleeves and including a first end outside the retaining sleeves and a second end located in one of the retaining sleeves that is most distal to the first end of the stem, said one of the retaining sleeves that is most distal to the first end of the stem including an end wall, the stem including a plurality of spaced protrusions for releasably engaging with the grooves of the retaining sleeves; and a spring mounted around the stem and attached between the first end of the stem and one of the retaining sleeve for biasing the first end of the stem and the end wall of the retaining wheel away from each other;

the male buckle member including two resilient push members respectively formed on two sides thereof, each said resilient member including a barb, one of the resilient push members being located outside the first end of the stern; the other of the resilient push members being located outside the end wall of said one of the retaining sleeves most distal to the first end of the stem;

the female buckle member including two side retaining holes each having a retaining member for releasably engaging with the barb of an associated said resilient member;

said means for releasably engaging with the strap being a slide member mounted in the female buckle member and including two protrusions on a first side thereof and a series of teeth on a second side thereof for releasably engaging with the strap, the slide member being slidable relative to the female buckle member along a lateral direction;

whereby when the male buckle member and the female buckle member are engaged with each other; the push members of the male buckle member push the protrusions of the slide member and thus make the teeth of the slide member move toward and thus engage with the strap to allow pulling of the second end of the strap in the first direction for further tightening the article and to prevent movement of the second end of the strap in the second direction opposite to the first direction for loosening the article;

whereby when the male buckle member and the female buckle member are disengaged with each other; the slide member is slidable away from the strap and thus makes the teeth of the slide member disengage from the strap to allow free movement of the second end of the strap;

whereby when the number wheels are not in correct code number position, the grooves of the retaining sleeves are not aligned with the protrusions of the stem such that the stem and the retaining wheels are not movable toward each other; the barbs of the male buckle member cannot be disengaged from the retaining elements of the female buckle member when the push members of the male buckle member are pushed toward each other; and whereby when the number wheels are in the correct code number position, the grooves of the retaining sleeves are aligned with the protrusions of the stem such that the stem and the retaining wheels are movable toward each other; the barbs of the male buckle member are disengaged from the retaining elements of the female buckle member when the push members of the male buckle member are pushed toward each other.

10. The strap lock as claimed in claim 9, wherein the lock assembly is a number lock.

11. The strap lock as claimed in claim 10, wherein a code number for unlocking the number lock is resettable.

* * * * *